US008727753B2

(12) United States Patent
Ishibashi et al.

(10) Patent No.: US 8,727,753 B2
(45) Date of Patent: May 20, 2014

(54) AIR PUMP

(75) Inventors: Shigemitsu Ishibashi, Kawasaki (JP); Atsuki Hashimoto, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

(21) Appl. No.: 13/193,071

(22) Filed: Jul. 28, 2011

(65) Prior Publication Data

US 2011/0280752 A1 Nov. 17, 2011

Related U.S. Application Data

(63) Continuation of application No. PCT/JP2010/051233, filed on Jan. 29, 2010.

(30) Foreign Application Priority Data

Jan. 30, 2009 (JP) ..... 2009-019860

(51) Int. Cl.
*F04B 39/00* (2006.01)

(52) U.S. Cl.
CPC ..... *F04B 39/0038* (2013.01); *F04B 39/0061* (2013.01)
USPC ..... 417/542; 417/540; 417/312

(58) Field of Classification Search
CPC ..... F04B 39/0038; F04B 39/0061
USPC ..... 417/540, 542, 312; 181/403
See application file for complete search history.

(56) References Cited

U.S. PATENT DOCUMENTS 4,960,368 A * 10/1990 Lilie ..... 417/312
5,052,904 A * 10/1991 Itakura et al. ..... 417/363
5,137,433 A * 8/1992 Willinger et al. ..... 417/312
5,213,484 A * 5/1993 Hashimoto et al. ..... 417/312
5,282,727 A * 2/1994 Willinger et al. ..... 417/423.15
6,017,197 A * 1/2000 Jensen et al. ..... 417/312
6,382,931 B1 * 5/2002 Czabala et al. ..... 417/312
6,382,935 B1 * 5/2002 Mikiya et al. ..... 417/413.1
6,488,482 B1 * 12/2002 Yannascoli et al. ..... 417/312
7,181,926 B2 * 2/2007 Bhatia et al. ..... 62/296

FOREIGN PATENT DOCUMENTS

EP 1903215 A1 * 3/2008 ..... F04B 35/04
JP 48-055404 U 7/1973
JP 50-085815 A 7/1975
JP 51-099312 A 9/1976
JP 59-126118 U 8/1984
JP 06-000627 Y 1/1994

OTHER PUBLICATIONS

International Search Report for International Application No. PCT/JP2010/051233, dated Apr. 13, 2010, 2 pages.

* cited by examiner

*Primary Examiner* — Christopher Bobish
(74) *Attorney, Agent, or Firm* — Brinks Gilson & Lione

(57) ABSTRACT

There is provided an air pump in which vibration noise generated in a drive unit of the pump is suppressed from being transmitted to the outside through a suction passage. A casing of the air pump has a suction port extending from an outer peripheral surface to inner peripheral surface of the casing, a noise reduction wall annularly formed on the outer peripheral surface of the casing such that the suction port opens in a region of the outer peripheral surface of the casing surrounded by the noise reduction wall, and a lid member closing the opening of the top of the noise reduction wall and cooperating with the noise reduction wall and the outer peripheral surface of the casing to define a noise reduction chamber communicating with the suction port. The noise reduction wall has an elongated noise reduction passage extending circumferentially in the noise reduction wall.

4 Claims, 9 Drawing Sheets

AIR PUMP

RELATED APPLICATIONS

This application is a continuation of PCT/JP2010/051233 filed on Jan. 29, 2010, which claims priority to Japanese Application No. 2009-019860 filed on Jan. 30, 2009. The entire contents of these applications are incorporated herein by reference.

BACKGROUND OF THE INVENTION

1. Field of the Invention

The present invention relates to air pumps and, more particularly, to a noise reduction device for use in air pumps.

2. Description of the Related Art

An air pump sucks in air from the surroundings, compresses the air and discharges the compressed air. In this regard, vibration noise generated in a drive unit of the pump is transmitted to the outside through an air suction passage and so forth, thus emitting noise to the surroundings. Accordingly, various noise reduction devices have been developed.

For example, the following patent literature 1 discloses a noise reduction device having a circular cylindrical housing accommodating an air pump unit, wherein the housing is provided with noise reduction means. In the noise reduction device, an inner wall is provided inside a circular cylindrical wall (outer wall) of the housing to extend over about 300 degrees in parallel to the cylindrical wall to form a suction passage between the two walls. In one end of the passage, the inner wall is connected to the cylindrical wall to form a closed end. The other end of the passage is an open end. Air outside the housing is sucked into the suction passage from near the closed end and passed through the passage to the open end, from which the air enters the interior of the housing, in which the pump unit is accommodated. In the noise reduction device, the suction passage is lengthened in this way to suppress noise from being transmitted to the outside through the suction passage.

Patent Literature 1: Japanese Examined Utility Model Application Publication No. 1994-00627

SUMMARY OF THE INVENTION

An object of the present invention is to provide an air pump in which a housing accommodating a pump unit is not used as a noise reduction device as stated above, but noise reduction means is provided in a suction section of the pump unit itself to further improve the noise reduction effect.

The present invention provides an air pump including a casing having a cylinder chamber. The casing accommodates a piston reciprocatable in the cylinder chamber and an electromagnetic drive unit for reciprocating the piston. The casing comprises a suction port extending from an outer peripheral surface to inner peripheral surface of the casing to suck air, which is to be supplied to the cylinder chamber, into the casing from the surroundings of the casing, an annular noise reduction wall annularly provided on the outer peripheral surface of the casing such that the suction port opens in a region of the outer peripheral surface of the casing surrounded by the noise reduction wall, and a lid member provided to close an opening defined by the top of the noise reduction wall. The lid member cooperates with the noise reduction wall and the outer peripheral surface of the casing to define a noise reduction chamber communicating with the suction port. The noise reduction wall has at least one elongated noise reduction passage extending circumferentially in the noise reduction wall. One end of the noise reduction passage opens on the outer surface of the noise reduction wall. The other end of the noise reduction passage opens on the inner surface of the noise reduction wall.

In this air pump, the casing is formed with a noise reduction wall as stated above, and air to be sucked into the casing is passed through a noise reduction passage formed in the noise reduction wall and introduced into the noise reduction chamber. From the noise reduction chamber, the air is introduced into the casing through a suction port provided to extend through the casing. Accordingly, the path extending from the casing to the outside through the suction port and the noise reduction chamber and further through the noise reduction passage is long so that it is possible to achieve a noise reduction effect to reduce noise leaking out of the casing through the path. The noise reduction chamber can be formed as a wide space, which makes it possible to further increase the noise reduction effect by a combination of the wide-space noise reduction chamber and the narrow noise reduction passage and suction port, which are upstream and downstream, respectively, of the noise reduction chamber. It should be noted that the lid member may be integrally formed with the noise reduction wall.

Specifically, the arrangement may be as follows. The noise reduction wall has a first annular wall, the opposite ends of which are not connected to each other, and a second annular wall extending parallel to the first annular wall, the opposite ends of the second annular wall not being connected to each other. The noise reduction passage is defined between the first and second annular walls.

More specifically, the arrangement may be as follows. The first annular wall extends around the noise reduction chamber. One end of the first annular wall is positioned more outward than the other end thereof with respect to the noise reduction chamber. The second annular wall extends from an inner end thereof in parallel to the first annular wall in the same direction as the direction in which the first annular wall extends from the one end toward the other end. The inner end of the second annular wall is located in the middle in the longitudinal direction of the first annular wall and inward of the first annular wall. The second annular wall passes between the one end and the other end of the first annular wall and extends parallel to and outside the first annular wall to reach an outer end thereof located outward of the inner end.

In the above-described air pump, a portion of the casing that defines the suction port may be made greater in wall thickness than a portion of the casing surrounding the suction port-defining portion to lengthen the length of the suction port. This is for increasing the noise reduction effect.

The suction port may comprise a plurality of holes of a small diameter. The smaller the diameter of the holes, the higher the noise reduction effect.

DETAILED DESCRIPTION OF THE PREFERRED EMBODIMENTS

Figure 1:
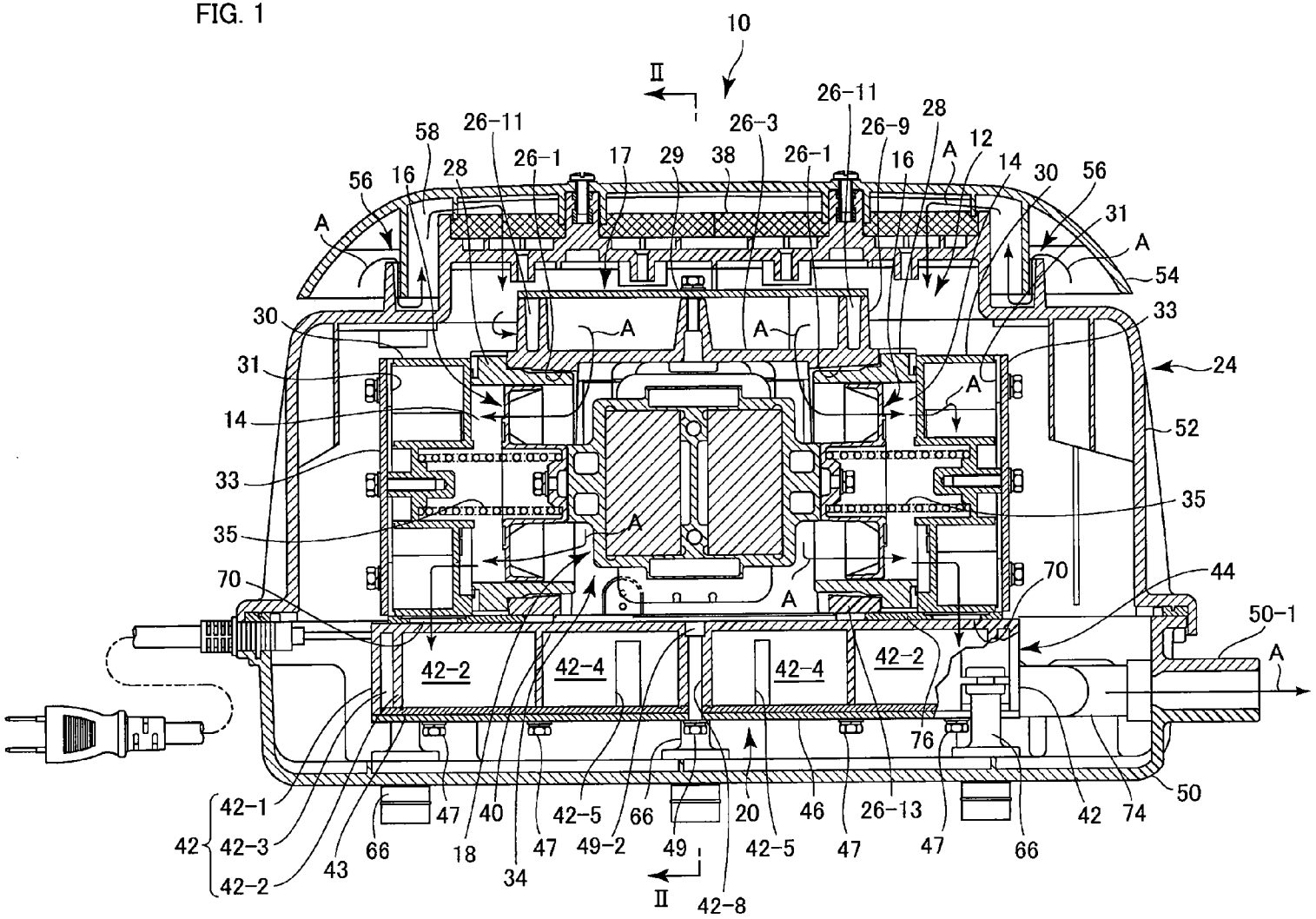
FIG. 1 is a vertical sectional view of an air pump according to the present invention.

An embodiment of an air pump according to the present invention will be explained below in detail with reference to the accompanying drawings.

As illustrated in the figures, an air pump 10 according to the present invention has a pump unit 12 for sucking in and compressing air from the surroundings and an air tank 20 for temporarily storing the compressed air from the pump unit 12 to suppress pulsation caused by reciprocating motion of pistons 16 of the pump unit 12 before discharging the compressed air. The air pump 10 further has a housing 24 accommodating the pump unit 12 and the air tank 20.

First, these constituent elements and the overall structure will be outlined below.

First, the pump unit 12 has a casing 17 having a pair of cylinder chambers 14 disposed in bilateral symmetry as seen in FIG. 1 to accommodate the pistons 16, respectively. The pump unit 12 further has an electromagnetic drive unit 18 reciprocating the two pistons 16 in the state of the two pistons being connected to each other. Specifically, the casing 17 has, as shown in FIGS. 2 to 5, a casing body 26 having a box shape as a whole and defining a drive chamber accommodating the electromagnetic drive unit 18, and a pair of cylinder members 28 fitted into through-holes 26-1 formed in left and right (as seen in FIG. 1) side walls 26-13, respectively, of the casing body 26. Further, the casing 17 has head covers 30 installed so as to sandwich the casing body 26 from the left and right sides of the latter to define the cylinder chambers 14 together with the cylinder members 28, and end wall members 33 abutted and secured to the respective end surfaces of the head covers 30 through seal members 31.

Figure 2:
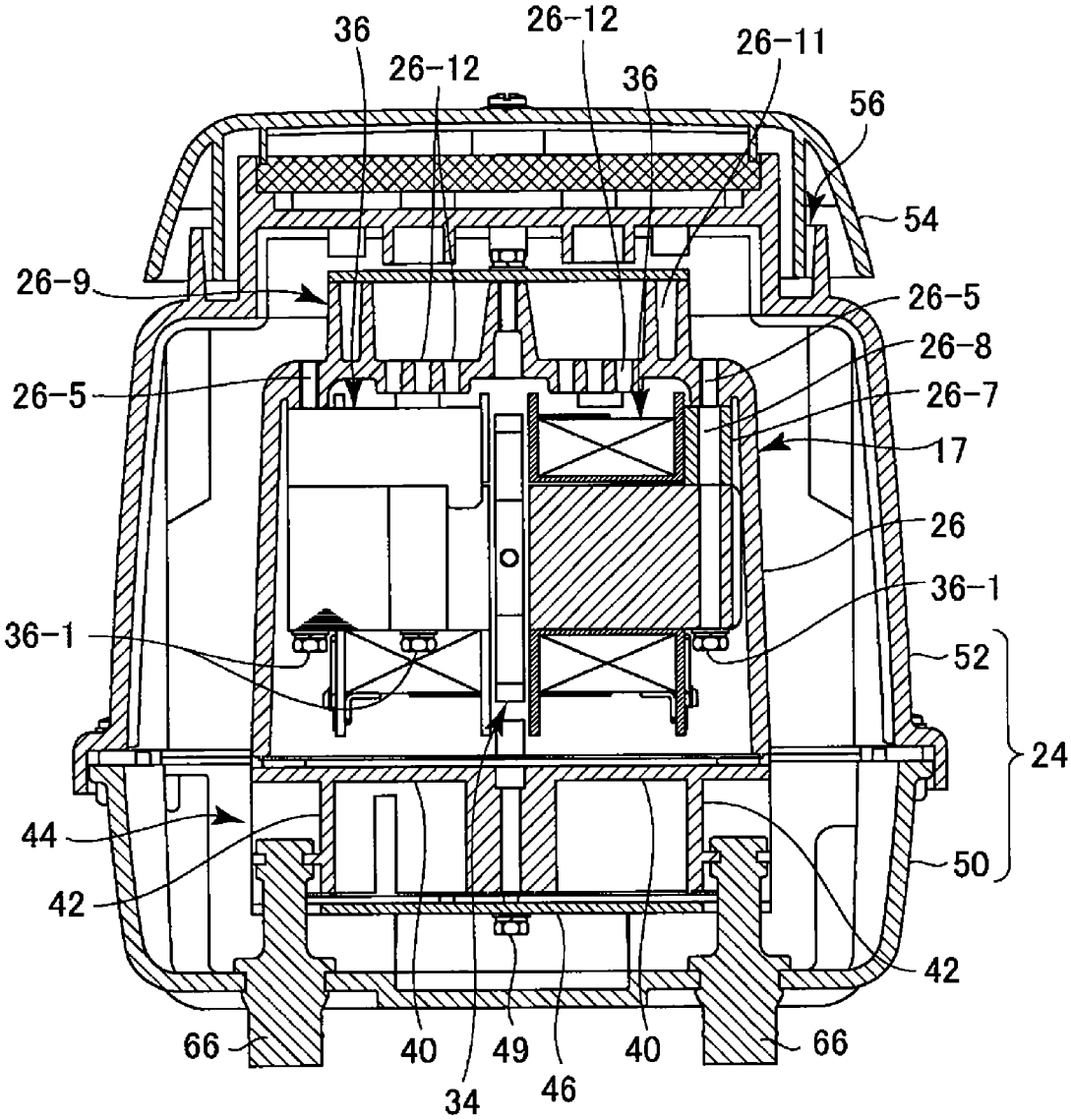
FIG. 2 is a sectional view taken along the line II-II in FIG. 1.

The electromagnetic drive unit 18 has an armature 34 connecting the pair of pistons 16 to each other and having plate-shaped permanent magnets 32 disposed in bilateral symmetry as seen in FIG. 1, and electromagnets 36 provided at the opposite sides, respectively, of the armature 34 as seen in FIG. 2. The electromagnets 36 act on the permanent magnets 32, thereby causing the armature 34 to reciprocate in the lateral direction as seen in FIG. 1. Coil springs 35 are provided at the left and right sides, respectively, of the armature 34 as seen in FIG. 1 to hold the armature 34 in the center of the pump unit 12. When an alternating electric current is applied to the electromagnets 36, an alternating magnetic field is generated to reciprocate the armature 34 equipped with the permanent magnets 32, together with the pistons 16 at the opposite ends of the armature 34. Consequently, the surrounding air is sucked into the pump unit 12 through a filter 38 installed in the top of the housing 24. The sucked air is compressed in the cylinder chambers 14 and supplied into the air tank 20. The flow of air is, although the details of the air flow path are not shown, as follows. As shown by the arrows A, first, the air enters the drive chamber in the casing 17. Then, the air passes through check valves (not shown) provided in the pistons 16 to reach the cylinder chambers 14. The electromagnetic drive unit 18 is a technique known to those skilled in the art as disclosed, for example, in Japanese Patent Application Publication No. 2007-16761. Therefore, a detailed explanation of the structure of the electromagnetic drive unit 18 is omitted herein.

The air tank 20 has a resinous tank body 44 having a rectangular top wall 40 on which the pump unit 12 is placed. The tank body 44 further has a peripheral wall 42 extending downward from the top wall 40. Thus, the tank body 44 has a downward facing opening. The air tank 20 further has a metallic bottom wall member 46 installed to close the opening of the tank body 44. The bottom wall member 46 has a plurality of bolts 47 passed through a peripheral edge portion thereof. The bolts 47 are thread-engaged with the metallic casing 17 of the pump unit and tightened to clamp the resinous tank body 44 between the metallic bottom wall member 46 and the casing 17.

Specifically, the housing 24, which accommodates the pump unit 12 and the air tank 20, has a flat-bottomed pan-shaped bottom part 50, a housing body 52 installed on the bottom part 50, and a cover 54 attached to the top of the housing body 52. An air intake passage 58 with a rainwater trap portion 56 is provided between the cover 54 and the housing body 52. Air introduced into the housing 24 through the rainwater trap portion 56 passes into the inside of the housing body 52 through the filter 38 provided in the top of the housing body 52. The bottom part 50 of the housing 24 supports the air tank 20 through support studs 66 made of a damper rubber.

The above is the outline of the air pump according to the present invention. The following is an explanation of the details of the air pump.

Figure 3:
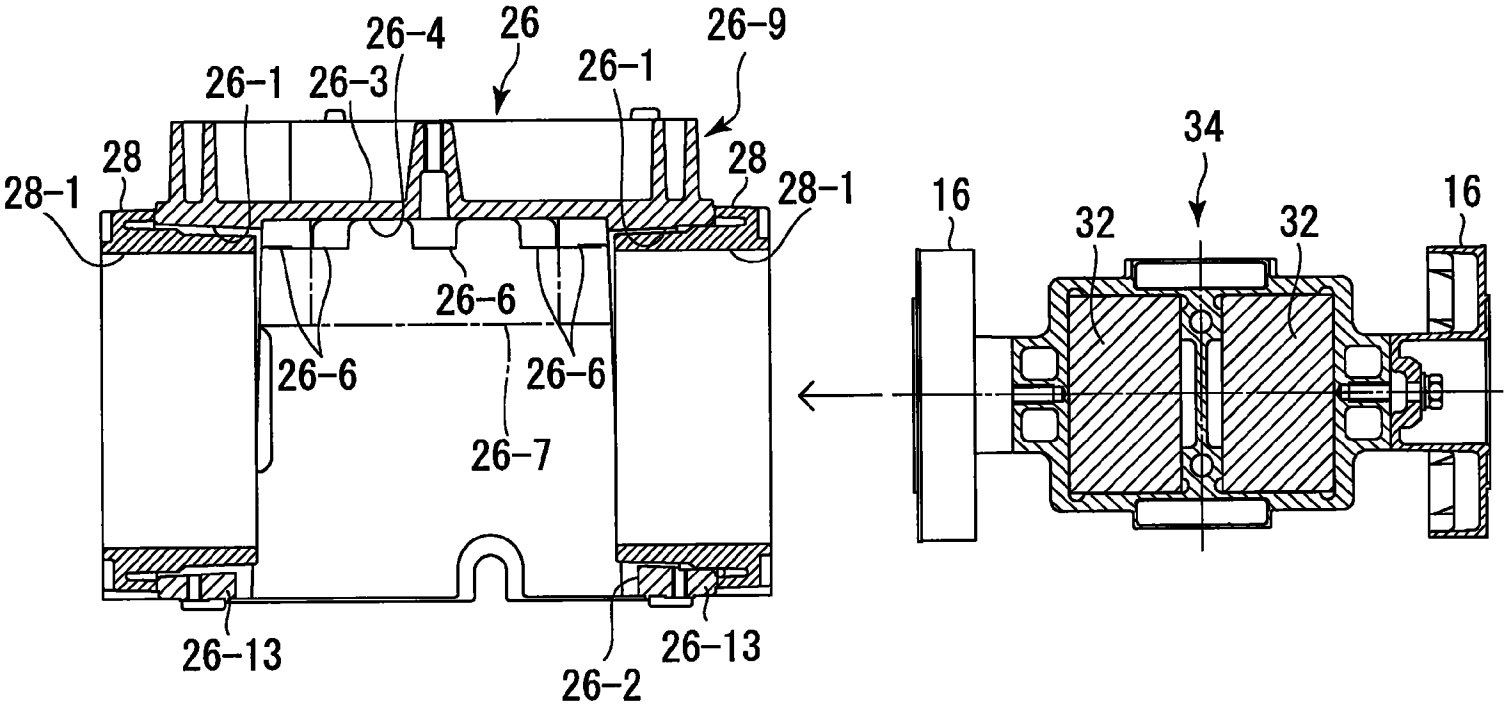
FIG. 3 is a sectional front view showing an assembly of a casing body constituting a casing of a pump unit and cylinder bodies and an assembly of pistons and an armature, in which only one of the pistons is not cut by the section line.
Figure 4:
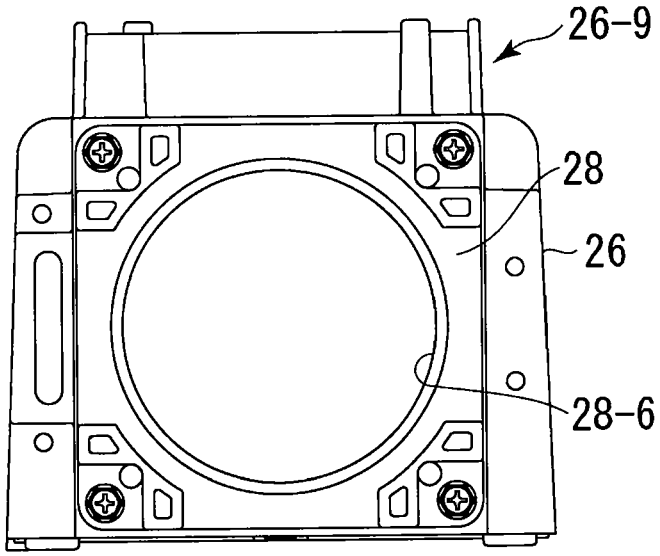
FIG. 4 is a side view of the assembly of the casing body and the cylinder bodies.
Figure 5:
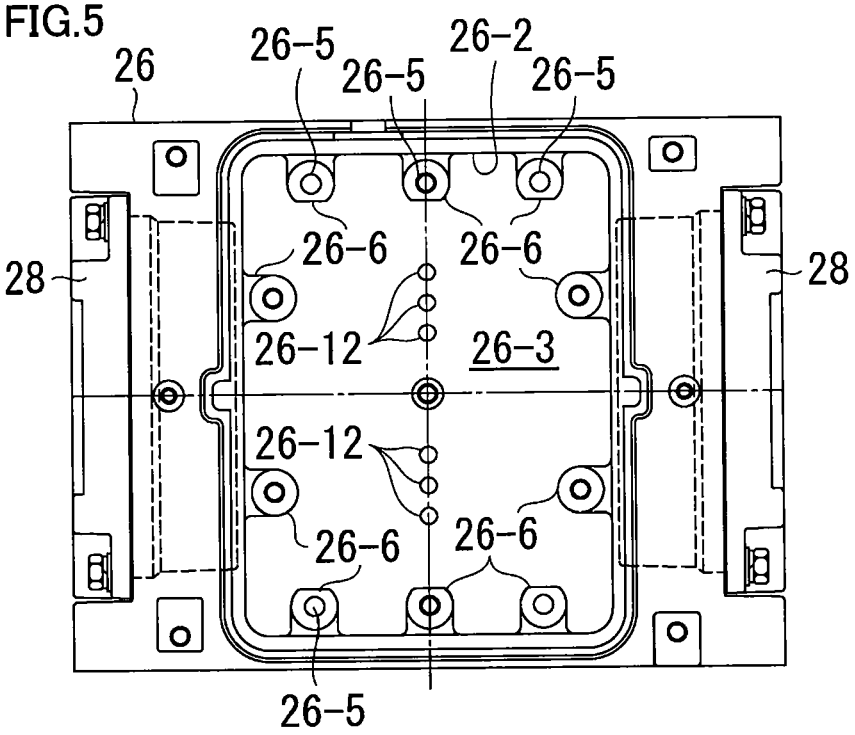
FIG. 5 is a bottom view of the assembly of the casing body and the cylinder bodies.

FIG. 3 shows an assembly of the casing body 26 and a pair of cylinder members 28 fitted into the left and right (as seen in the figure) through-holes 26-1, respectively, of the casing body 26 to constitute the casing 17, and also shows an assembly of the pistons 16 and the armature 34, which is to be loaded into the first-mentioned assembly. The casing body 26 has an electromagnet-loading opening 26-2 in the center of the bottom wall thereof. As shown in FIG. 5, the opening 26-2 is rectangular in shape as seen from below. Regarding the pair of cylinder members 28, one cylinder member 28 is inserted into one through-hole 26-1 and bolted, and the other cylinder member 28 is inserted into the other through-hole 26-1 and bolted in a state where a circular cylindrical inner peripheral surface 28-1 of the other cylinder member 28, which receives the associated piston 16, is axially aligned with the inner peripheral surface 28-1 of the one cylinder member 28 (see FIGS. 4 and 5). The assembly of the armature 34 and the pistons 16 can be set in the casing body 26 by inserting, as shown in FIG. 3, the assembly into the casing body 26 from the outside thereof through one cylinder member 28 in the axial direction thereof.

Figure 6:
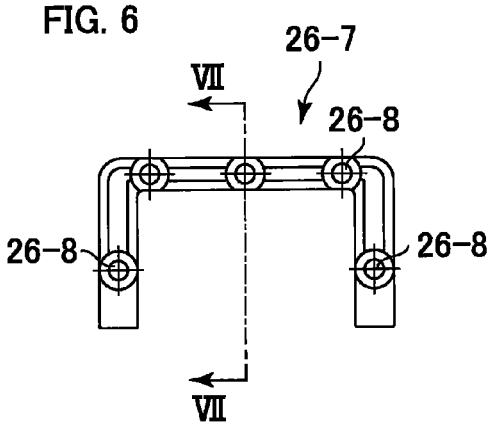
FIG. 6 is a plan view of an electromagnet pedestal member.
Figure 7:
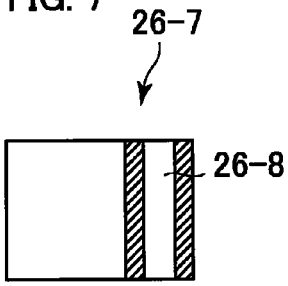
FIG. 7 is a sectional view taken along the line VII-VII in FIG. 6.
Figure 8:
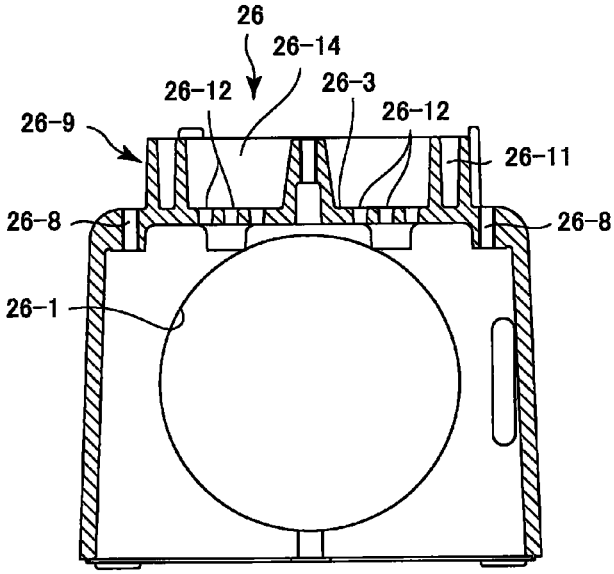
FIG. 8 is a sectional view taken along the line VIII-VIII in FIG. 9.

As shown in FIGS. 5 and 3, the casing body 26 has a top wall 26-3 with an inner surface 26-4 corresponding to the electromagnet-loading opening 26-2 of the bottom wall thereof. The inner surface 26-4 of the top wall 26-3 is provided with mutually spaced internal thread portions 26-6 having threaded holes 26-5 vertically extending through the top wall 26-3. The internal thread portions 26-6 are positioned corresponding to the peripheral edge of the bottom opening 26-2. The internal thread portions 26-6 are provided symmetrically about a horizontal line as seen in FIG. 5. As shown in FIGS. 6 and 7, a U-shaped electromagnet pedestal member 26-7 has holes 26-8 provided corresponding to the threaded holes 26-5. The electromagnet pedestal member 26-7 is provided for each of the upper and lower groups of internal thread portions 26-6 and abutted against the associated internal thread portions 26-6. As shown in FIG. 2, bolts 36-1 are inserted through the electromagnets 36 from below and further through the holes 26-8 and thread-engaged with the threaded holes 26-5 of the internal thread portions 26-6, thereby setting the electromagnets 36 at respective proper height positions with respect to the permanent magnets 32 of the armature 34.

Figure 9:
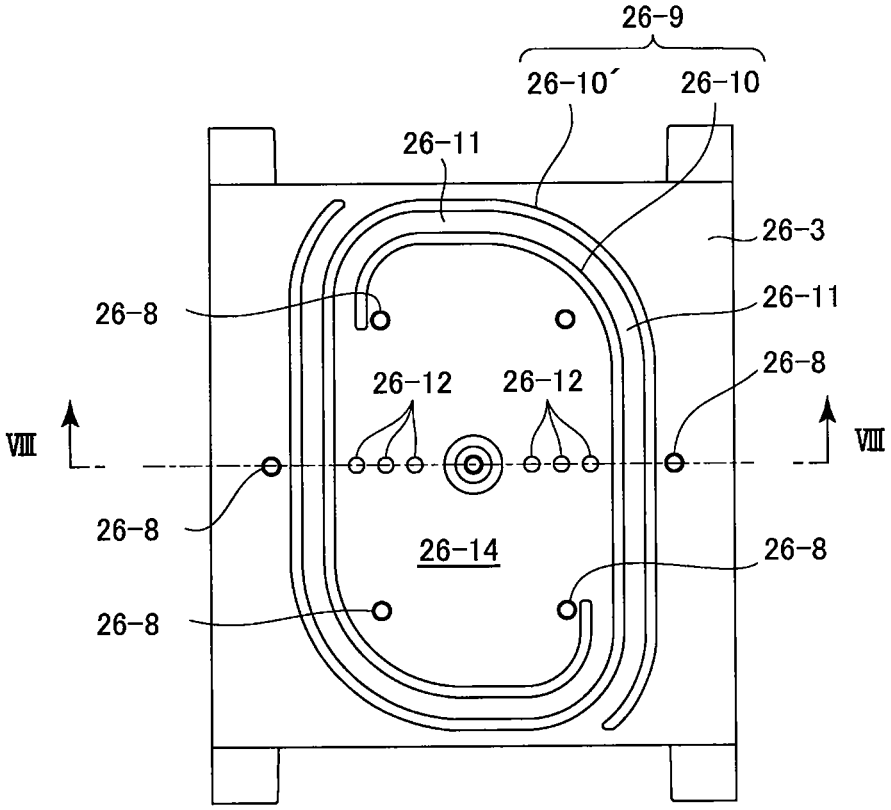
FIG. 9 is a plan view of the casing body.

The casing body 26 has a noise reduction wall 26-9 standing on the upper surface of the top wall 26-3. Specifically, the noise reduction wall 26-9 comprises, as shown in FIG. 9, a pair of parallel extending loop-shaped or annular walls 26-10 and 26-10'. One wall 26-10 extends counterclockwise from the upper left of the figure through about 360° such that the terminating end of the wall 26-10 is inward of the starting end thereof. The other wall 26-10' extends clockwise from a lower right position in parallel to and inward of the one wall 26-10, passes between the starting and terminating ends of the one wall 26-10, and further extends parallel to and outward of the one wall 26-10. The other wall 26-10' extends through about 360° in total. Between the walls 26-10 and 26-10' is formed an air intake passage 26-11 also functioning as a noise reduction passage. A plate-shaped lid member 29 is placed on and bolted to the top of the noise reduction wall 26-9. Thus, a noise reduction chamber 26-14 is defined by the outer peripheral surface of the housing, the noise reduction wall 26-9 and the lid member 29. Air introduced into the housing body 52 through the filter 38 provided in the top of the housing body 52 enters the noise reduction chamber 26-14 through the noise reduction passage 26-11 and is introduced into the casing body 26 through holes 26-12 (FIGS. 2 and 5) provided to extend through the top wall 26-3. The inner surface defining the holes 26-12 of the top wall 26-3 extends downward to lengthen the holes 26-12. The noise reduction wall 26-9, the noise reduction chamber 26-14, the holes 26-12 and so forth are configured so that noise generated by the reciprocating motion of the armature 34 is reduced and suppressed from being transmitted to the outside through air-introducing passages such as the holes 26-12, the noise reduction chamber 26-14 and the noise reduction passage 26-11.

Figure 10:
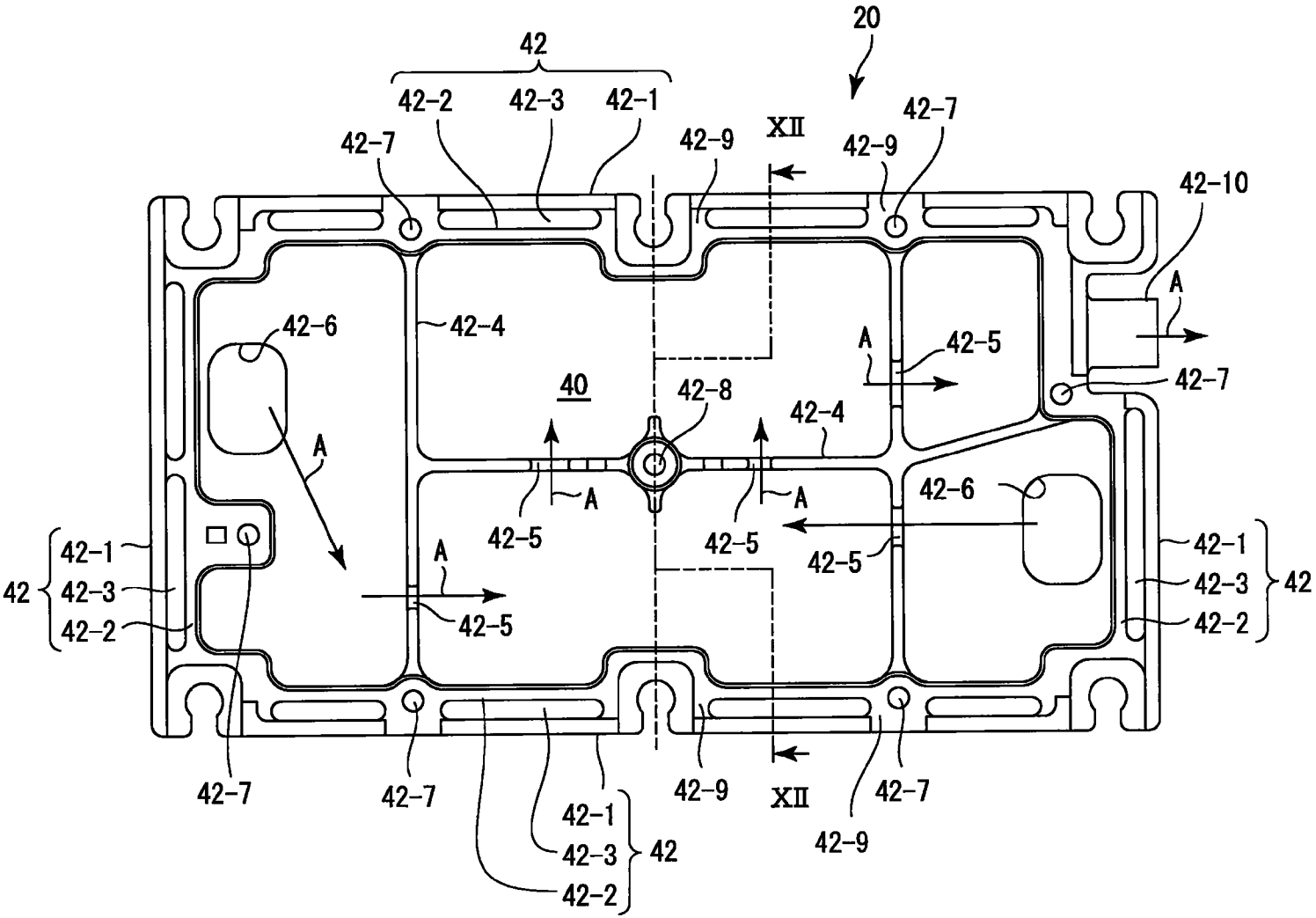
FIG. 10 is a bottom view of a tank body.
Figure 11:
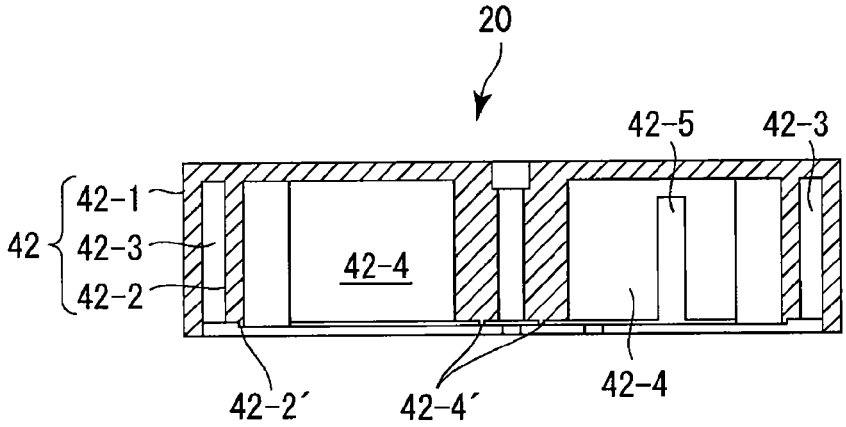
FIG. 11 is a sectional view taken along the line XI-XI in FIG. 10.
Figure 13:
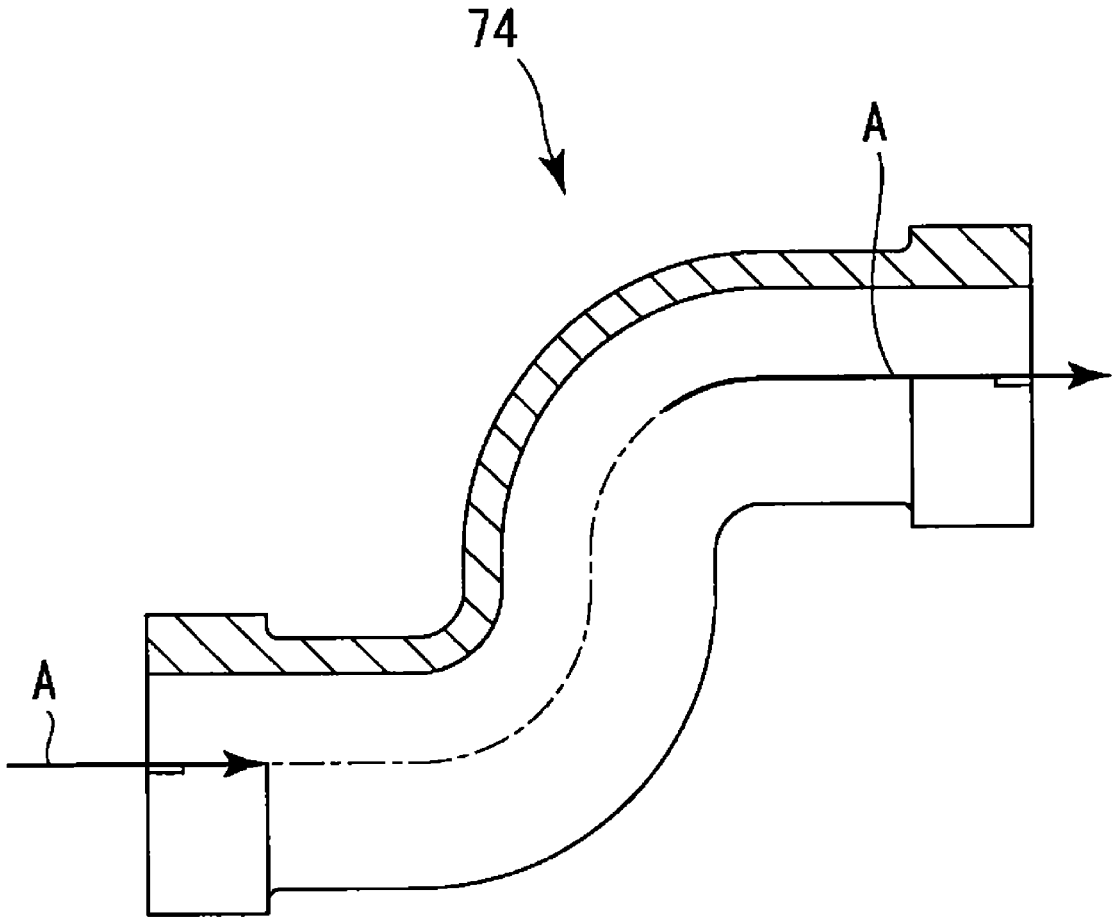
FIG. 13 is a plan view of an S-shaped pipe connecting between an air outlet of an air tank and an air discharge port of a housing.

The air tank body 44 has a peripheral wall 42 having a double-wall structure comprising, as shown in FIGS. 1, 10 and 11, an outer wall 42-1, an inner wall 42-2, and an air gap 42-3 provided between the outer and inner walls 42-1 and 42-2, thereby making it difficult for the vibration noise of air in the tank to be transmitted to the outside. In the illustrated example, a plurality of air gaps 42-3 are formed being spaced from each other in the circumferential direction of the peripheral wall 42. An intermediate wall 42-9 is formed between each pair of mutually adjacent air gaps 42-3 to connect together the outer and inner walls 42-1 and 42-2. In the air tank body 44, partition walls 42-4 are formed being suspended from the top wall 40 of the air tank body 44 to partition the interior space of the air tank body 44 into a plurality of spaces. Each partition wall 42-4 is provided with an air passage 42-5 extending upward from the bottom of the partition wall 42-4. Air introduced from air inlets 42-6 provided in the top wall 40 flows to an air outlet 42-10 through the air passages 42-5, thereby suppressing the pulsation of air discharged from the air outlet 42-10. The partition walls 42-4 and the inner wall 42-2 are shorter in length than the outer wall 42-1. The air outlet 42-10 is connected to an air discharge port 50-1 of the housing bottom part 50 through an S-shaped pipe 74 as shown in FIG. 13. The purpose of using the S-shaped pipe 74 is to absorb vibrations between the housing bottom part 50 and the air tank 20.

The peripheral wall 42 is provided with a plurality of screw-receiving holes 42-7 vertically extending therethrough. The bolts 47 inserted through the peripheral portion of the metallic bottom wall member 46 are passed through the screw-receiving holes 42-7 and thread-engaged with the bottom portion of the metallic casing 17, thereby clamping the air tank body 44 between the bottom wall member 46 and the bottom portion of the casing 17. The partition wall 42-4 in the center of the air tank body 44 is also provided with a screw-receiving hole 42-8. A bolt 49 inserted through the center of the bottom wall member 46 is passed through the screw-receiving hole 42-8, and the distal end of the bolt 49 is thread-engaged with a nut 49-1 fitted into the upper end of the screw-receiving hole 42-8, thereby securing the bottom wall member 46 to the tank body 44. The bottom wall member 46 has a sheet-shaped seal member 43 stacked on the upper surface thereof inside the outer wall 42-1 of the air tank body 44. The seal member 43 is made of a material more flexible than the resin used to form the air tank body 44. Thus, the inner wall 42-2 and partition walls 42-4 of the air tank body 44 sealingly clamp the seal member 43 between themselves and the bottom wall member 46. As shown in FIG. 11, ridges 42-2' and 42-4' capable of being forced into the seal member 43 are provided on the bottoms of the inner wall 42-2 and partition walls 42-4 of the air tank body 44 to extend along the respective walls.

Figure 12:
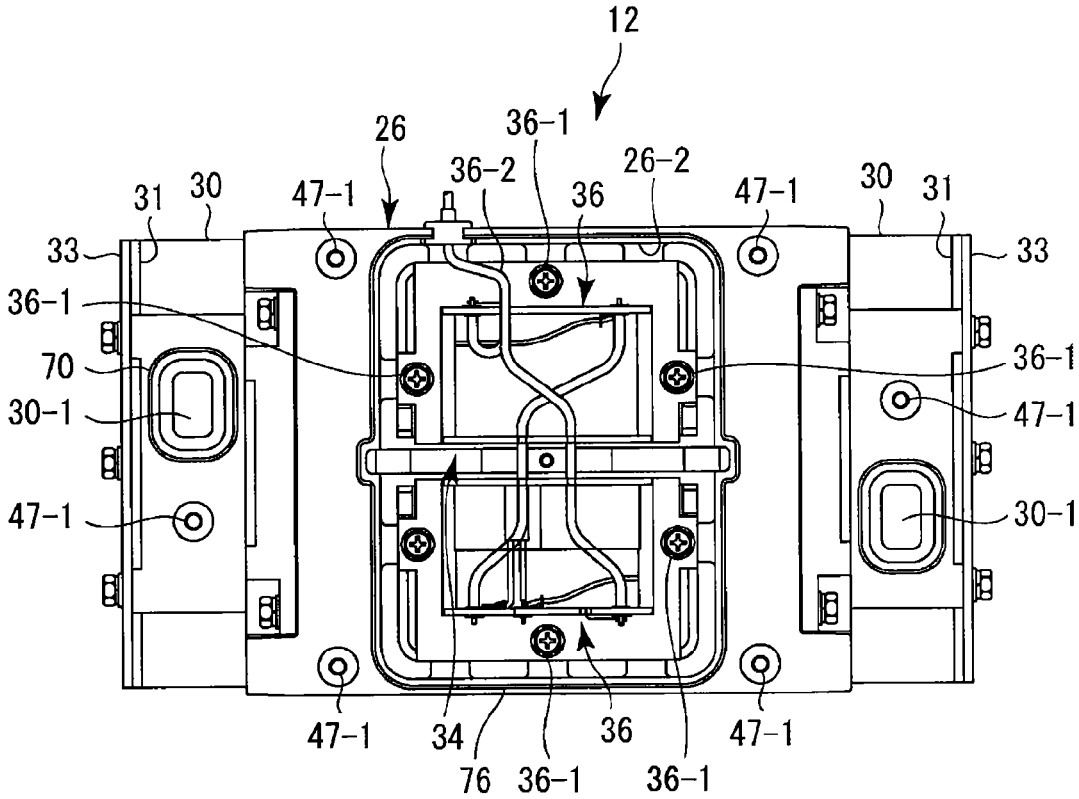
FIG. 12 is a bottom view of the pump unit.

FIG. 12 is a bottom view of the pump unit 12. Through the electromagnet-loading opening 26-2 of the casing body 26 are seen the armature 34 and the electromagnets 36 provided at the opposite sides of the armature 34, together with wiring 36-2 to the electromagnets 36. Threaded holes 47-1 are formed in the respective bottoms of the casing body 26 and the head covers 30. The distal (upper) ends of the bolts 47 are thread-engaged with the threaded holes 47-1, respectively, to secure the air tank body 44 as stated above The bottoms of the head covers 30 are further formed with air discharge openings 30-1, respectively, from which air discharged from the cylinder chambers 14 is discharged toward the air tank 20. The air discharge openings 30-1 are positioned to align with the air inlets 42-6 formed in the top wall 40 of the air tank body 44, which are shown in FIG. 10. Around the air discharge openings 30-1, annular ridges 70 are formed along the peripheral edges of the air discharge openings 30-1, respectively, so as to being forced into a sheet-shaped seal member 76 that is clamped between the air tank 20 and the bottom of the pump unit 12 when the former is secured to the latter, thereby sealingly engaging with the seal member 76. Around the electromagnet-loading opening 26-2, an annular ridge 76 is formed along the peripheral edge of the opening 26-2 so as to engage with the peripheral edge portion of an opening formed in the seal member 76 to correspond to the electromagnet-loading opening 26-2.

What is claimed is:

1. An air pump including a casing having a cylinder chamber, the casing accommodating a piston reciprocatable in the cylinder chamber and an electromagnetic drive unit for reciprocating the piston;

the casing comprising:

a plurality of suction ports extending from an outer peripheral surface to an inner peripheral surface of the casing to suck air into the casing from surroundings of the casing, the air being to be supplied to the cylinder chamber;

an annular noise reduction wall annularly provided on the outer peripheral surface of the casing, the noise reduction wall having a radially inner surface annularly extending along the annular noise reduction wall and a radially outer surface annularly extending along the annular noise reduction wall; and a lid member provided to close an opening defined by a top of the noise reduction wall, the lid member cooperating with the radially inner surface of the noise reduction wall and the outer peripheral surface of the casing to define a flat noise reduction chamber surrounded by the radially inner surface;

wherein the suction ports are positioned inside of and spaced apart from the radially inner surface of the annular noise reduction wall to fluidly communicate with the flat noise reduction chamber; and the noise reduction wall has at least one elongated noise reduction passage extending in the noise reduction wall in a circumferential direction of the noise reduction wall, one end of the noise reduction passage opening on the outer surface of the noise reduction wall, the other end of the noise reduction passage opening on the inner surface of the noise reduction wall so that the air is introduced from the surroundings into the flat noise reduction chamber through the at least one elongated noise reduction passage and then into the casing through the suction ports, wherein sounds are transmitted into the flat noise reduction chamber from an inside of the casing through the suction ports to each spread radially in the flat noise reduction chamber, and the spread sounds pass through the noise reduction passage opening from the flat noise reduction chamber to the surroundings, wherein the noise reduction wall has a first annular wall, opposite ends of which are not connected to each other, and a second annular wall extending parallel to the first annular wall, opposite ends of the second annular wall not being connected to each other, the noise reduction passage being defined between the first annular wall and the second annular wall, and wherein the first annular wall extends around the noise reduction chamber, one end of the first annular wall being positioned more outward than the other end thereof with respect to the noise reduction chamber, the second annular wall extending from an inner end thereof in parallel to the first annular wall in a direction opposite to a direction in which the first annular wall extends from the one end toward the other end, the inner end being located in a middle in a longitudinal direction of the first annular wall and inward of the first annular wall, the second annular wall passing between the one end and the other end of the first annular wall and extending parallel to and outside the first annular wall to reach an outer end thereof located outward of the inner end.

2. The air pump of claim 1, wherein the noise reduction wall is integrally formed with the outer peripheral surface of the casing.

3. The air pump of claim 1, wherein a portion of the casing that defines the suction port is greater in wall thickness than a portion of the casing surrounding the portion to lengthen a length of the suction port.

4. The air pump of claim 1, wherein the suction port comprises a plurality of holes of a small diameter.

* * * * *